US005535948A

United States Patent [19]

Williams

[11] Patent Number: 5,535,948

[45] Date of Patent: Jul. 16, 1996

[54] CONCRETE GRADE CROSSING PANELS HAVING INTEGRAL ELASTOMERIC SEALS

[75] Inventor: Jack Williams, Portland, Oreg.

[73] Assignee: Omni Products, Inc., Portland, Oreg.

[21] Appl. No.: 498,600

[22] Filed: Jul. 5, 1995

[51] Int. Cl.[6] ..... E01B 1/00

[52] U.S. Cl. ..... 238/8

[58] Field of Search ..... 238/2, 6, 7, 8, 238/9

[56] References Cited

U.S. PATENT DOCUMENTS

| | | | |
|---|---|---|---|
| 3,863,840 | 2/1975 | Szarka et al. | 238/8 |
| 4,236,670 | 12/1980 | Limmergard et al. | 238/8 |
| 4,415,120 | 11/1983 | Thim | 238/8 |
| 4,899,933 | 2/1990 | Martin | 238/8 |
| 5,181,657 | 1/1993 | Davis | 238/8 |

FOREIGN PATENT DOCUMENTS

| | | | |
|---|---|---|---|
| 1908832 | 1/1971 | Germany | 238/8 |

*Primary Examiner*—S. Joseph Morano
*Attorney, Agent, or Firm*—Chernoff, Vilhauer, et al.

[57] ABSTRACT

A rail grade crossing includes precast concrete panels which extend substantially between the roadway and the rails and between the rails. Elastomeric seals that are cast into the panels when they are formed fit between the panels and the rails. Because the seals are cast into the panels, the panels and seals are an integral unit which facilitates installation and removal of the panels.

3 Claims, 2 Drawing Sheets

CONCRETE GRADE CROSSING PANELS HAVING INTEGRAL ELASTOMERIC SEALS

BACKGROUND AND SUMMARY OF THE INVENTION

This invention relates to railroad grade crossings, and in particular to railroad grade crossings incorporating precast concrete panels with elastomeric seals between the panels and the rails.

When a railroad track crosses a roadway it is necessary to bring the space between the roadway and the rails, and the space between the rails, up to grade. This is accomplished by installing grade crossing elements into these spaces. In busy city streets it has become common to use precast concrete panels for this purpose. Concrete panels wear well and, therefore, with-stand the heavy traffic occurring on busy city streets. In addition, precast concrete panels are quickly installed which reduces the time the street is unavailable during installation of the crossing. Finally, precast concrete panels are easily and quickly removed to access the track for repairs and maintenance.

When precast concrete crossing panels are used it is desirable to place elastomeric seals between the panels and the rails. These seals provide a positive flangeway which prevents water from getting beneath the panels and weakening the ballast. The seals also create a cushioning transition between the rails and the concrete panels, which makes for a smoother ride for vehicles crossing the tracks and prevents chipping of the corners of the panels. The seals also reduce the transmission of vibration from the rails to the panels. Finally, elastomeric seals electrically isolate the rails from the panels. Precast concrete grade crossing panels with elastomeric seals are shown, for example, in Davis, U.S. Pat. No. 5,181,657 and Martin, U.S. Pat. No. 4,899,933.

With both of these prior art crossing systems the seal and concrete panels are separate elements. In Davis, the seal is partially overlaid by the panel, and the panel holds the seal in place. In Martin, the seal is inserted between the panel and the rail after the panel is installed. In either case, the seal complicates installation of the grade crossing, and with Martin the seal can become dislodged in use.

The subject invention overcomes this problem with the prior art precast concrete panel/elastomeric seal grade crossing systems by casting the seals into the panels to form integral panel seal units. In a preferred embodiment of the invention, the seal has a ledge with an downwardly projecting lip that is imbedded in the concrete panel.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
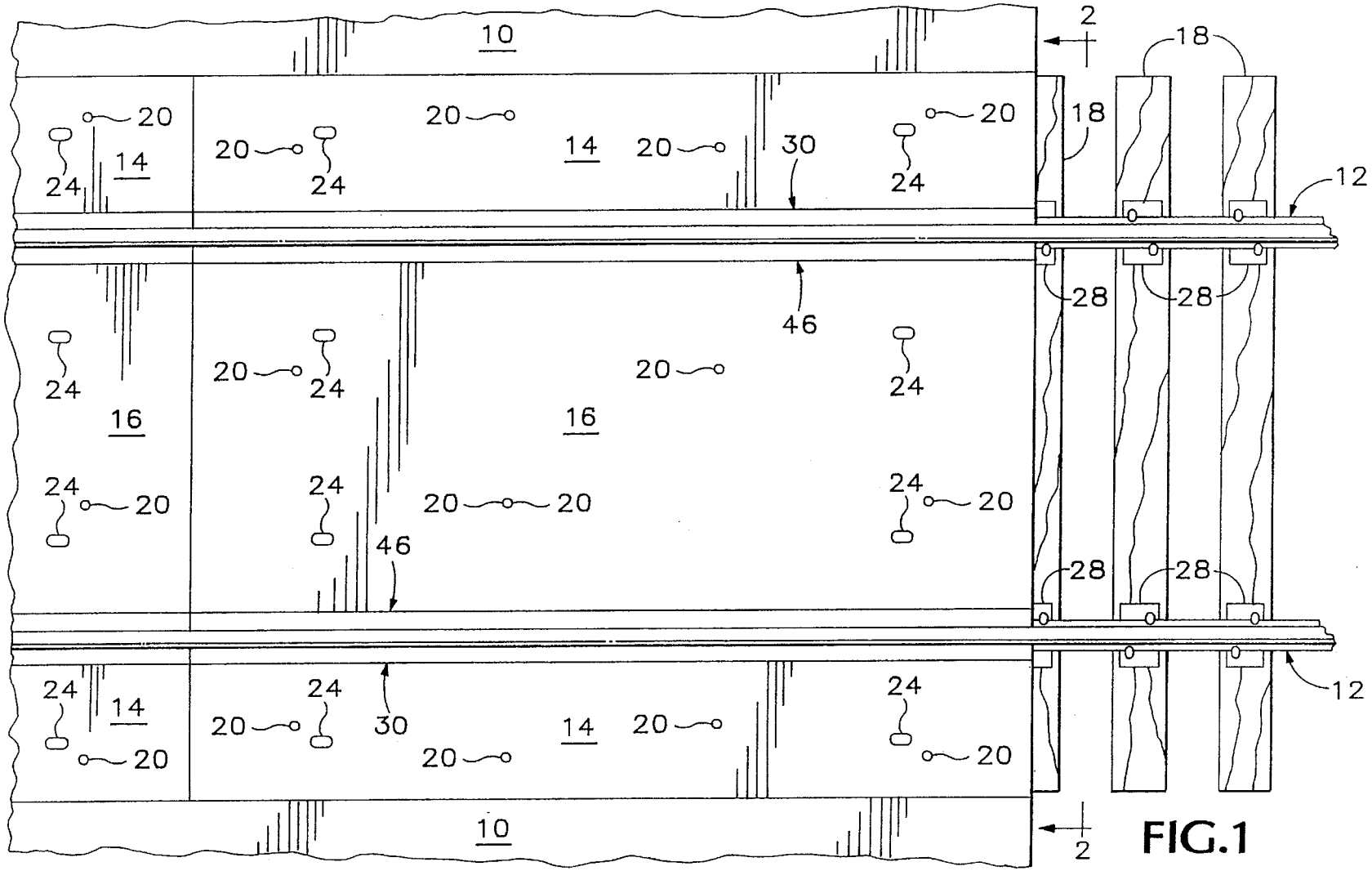
FIG. 1 is a fragmentary plan view, partially broken away, of a railroad grade crossing embodying the subject invention.
Figure 2:
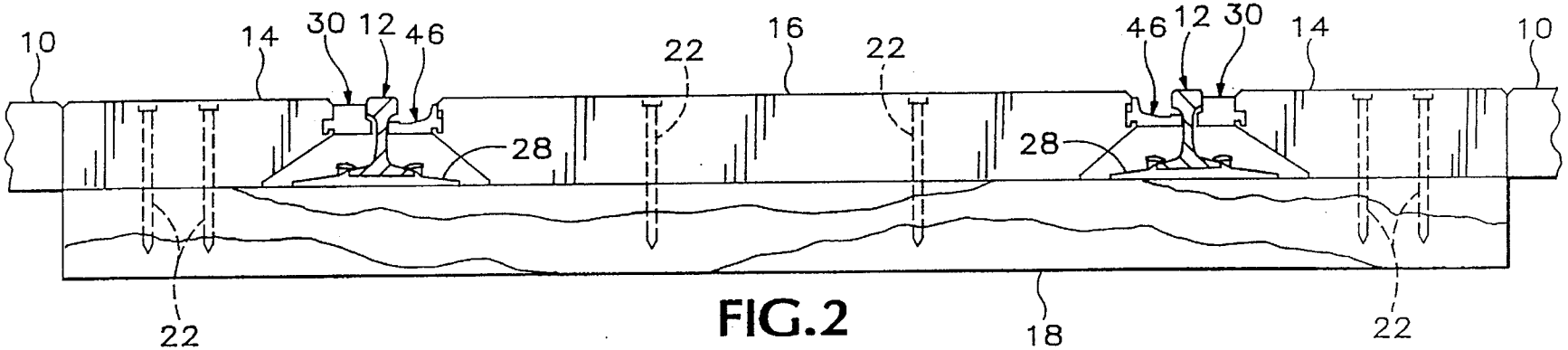
FIG. 2 is a sectional view taken along line 2—2 in FIG. 1.
Figure 4:
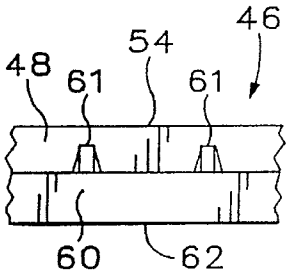
FIG. 4 is a detailed view, at an enlarged scale, showing a rib which is embedded in the concrete pad.

Referring to the drawings, when a railroad track crosses a roadway 10, a grade crossing must be installed that fills the open spaces between the roadway and the rails 12 and between the rails. This is accomplished in the subject invention by placing a precast concrete gauge panel 16 between the rails, and precast concrete field panels 14 between each rail and the edge of the roadway 10. These panels rest on the timber or concrete ties 18 that support the rails, and are held in place in the conventional manner. The panels have a thickness which makes their top surfaces coplanar with the roadway, and with the tops of the rails. In the embodiment shown in the drawings, the panels are shown with wood ties and they have counterbored holes 20 located in them and timber screws 22 are inserted through these holes and into the ties to secure the panels to the ties. The panels also have lifting eye pockets 24 placed in them to receive lifting hooks (not shown) to facilitate lifting the panels when they are being installed or removed. Precast concrete grade crossing panels in general are well known in the prior art, and are shown in Davis, U.S. Pat. No. 5,181,657, and Martin, U.S. Pat. No. 4,899,933.

The outer sides of the field panels 14 abut the roadway 10, although an expansion joint may be inserted between them. The inner sides of the field panels and both sides of the gauge panel are spaced apart from the adjacent rail and are undercut to fit over the tie plates 28 that are used to attach the rails to the ties.

Figure 3:
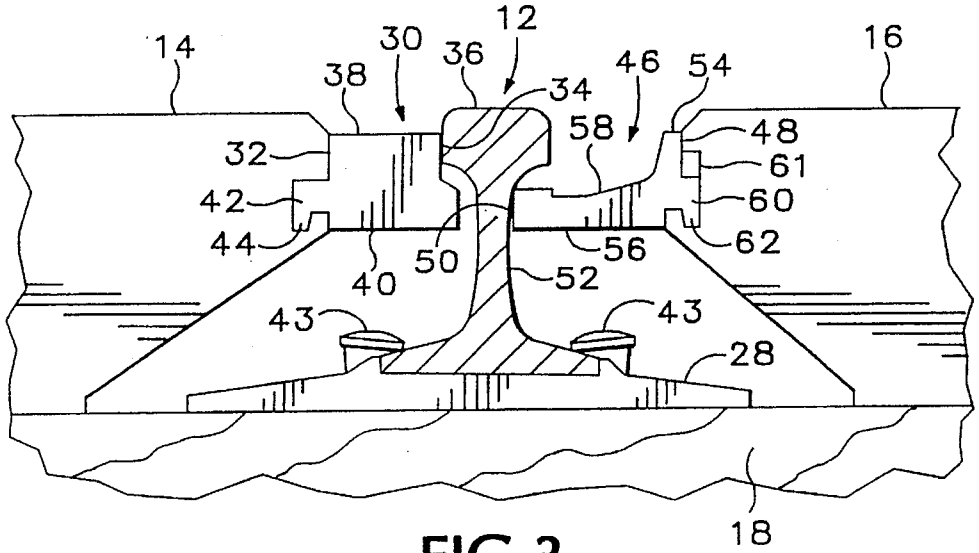
FIG. 3 is a detailed view, at an enlarged scale, showing how the seals in the grade crossing are embedded in the concrete pad and interact with the rails.

Referring now particularly to FIG. 3, located on the inner side of each field panel 14 is an elastomeric field seal 30 which spans between the field panel and the rail. The field seal 30 has a first side 32 that abuts the field panel 14 and a second side 34 that abuts the head 36 of the rail 12 and may or may not abut the rail web 52. The field seal also has a planar upper face 38 which is offset slightly downward from the top surface of the field panel 14, and a lower face 40 which is located above the fasteners 43 that attach the rails to the ties. Each field seal has a ledge 42 protruding from its first side 32 that is cast into the field panel when the field panel is formed. Thus, the field seal and the field panel form an integral unit. The ledge 42 has an downwardly extending lip 44 that assists it in bonding to the field panel.

Located on both sides of each gauge panel 16 is an elastomeric gauge seal 46 which spans between the gauge panel and the rail. The gauge seal 46 has a first side 48 that abuts the gauge panel and a second side 50 that fits under the rail head 36 and may or may not abut the rail web 52. The gauge seal also has a short planar upper face 54 which is offset slightly downward from the top surface of the gauge panel, and a lower face 56 which is located above the fasteners 43. A recess 58 extends between the upper face 54 and the second side to accommodate the wheel flange (not shown) of rail cars traveling on the tracks. The gauge seal has a ledge 60 protruding from its first side 48 that is cast into the gauge panel when it is formed. Thus, the gauge panel and gauge seals form an integral unit. The ledge 60 has an downwardly projecting lip 62 that assists it in bonding to the gauge panel. The gauge seal also has a series of spaced-part trapezoidal ribs 61 that project from its first side 48 above the ledge 60. The ribs also are cast into the concrete, and prevent the first side of the gauge seal from pulling away from the gauge panel when traffic passes over the crossing. If the first side of the gauge seal were to pull away from the gauge panel, material could drop between them and create a permanent separation.

The edges of both the gauge and field panels are chamfered to prevent them from becoming chipped by vehicles crossing over them. The chamfer on the sides of the panels that abut the respective seals has a depth which is equal to the amount the upper face of the seal is offset from the top surface of the panel.

Because the seals are integral with the panels installation and removal of the panels is greatly simplified, and the seals cannot become dislodged in use.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A railroad grade crossing for extending a paved roadway across a pair of parallel, spaced apart rails, comprising:

(a) a concrete gauge panel that extends substantially between the rails and has a planar top surface that is coplanar with the roadway;

(b) said gauge panel having elastomeric gauge seals on each side thereof which are adjacent to the rails when said gauge panel is located therebetween, said gauge seals having planar upper faces that are offset slightly downwardly from the top surface of said gauge panel, and recessed portions between said upper faces and the respective rail;

(c) a pair of concrete field panels, one of which extends substantially between each rail and the roadway, having planar top surfaces that are coplanar with the roadway;

(d) said field panels each having an elastomeric field seal on one side thereof, which is adjacent to the respective rail when said field panel is located between the rail and the roadway; wherein (e) said seals are cast into said panels to form integral panel/seal units, and each seal comprises a first face that is adjacent to the respective panel, an opposed second face that is adjacent to the respective rail, and a ledge that projects from said first face and is imbedded in the respective panel.

2. The grade crossing of claim 1 wherein said ledge has a substantially vertical lip.

3. The grade crossing of claim 1 wherein said field seal has a planar upper face that is offset slightly downward from the top surface of said field panel.

* * * * *